US005217058A

United States Patent [19]

Sourlier

[11] Patent Number: 5,217,058

[45] Date of Patent: Jun. 8, 1993

[54] METHOD AND APPARATUS FOR LOW-PRESSURE METAL CASTING

[75] Inventor: Pascal Sourlier, Maxeville, France

[73] Assignee: Pont-A-Mousson S.A., Nancy, France

[21] Appl. No.: 718,122

[22] Filed: Jun. 20, 1991

[30] Foreign Application Priority Data

Jun. 22, 1990 [FR] France ..... 90 07861

[51] Int. Cl.[5] ..... B22C 9/08; B22D 17/06

[52] U.S. Cl. ..... 164/119; 164/133; 164/306

[58] Field of Search ..... 164/119, 306, 133, 362, 164/255, 63

[56] References Cited

U.S. PATENT DOCUMENTS 2,940,142 6/1960 Wells et al. .
3,628,598 12/1971 MacNeil et al. .
3,656,539 4/1972 Zickefoose .
4,008,749 2/1977 Bellocci et al. ..... 164/119
4,112,997 9/1978 Chandley ..... 164/119
4,133,370 1/1979 Bellocci et al. .
4,143,687 3/1979 Bellocci .

FOREIGN PATENT DOCUMENTS 2295808 12/1974 France .
2367566 10/1976 France .
2556996 12/1983 France .

*Primary Examiner*—Kuang Y. Lin
*Attorney, Agent, or Firm*—Sughrue, Mion, Zinn, Macpeak & Seas

[57] ABSTRACT

The sum of the areas of the sections of the operational ingates 30 of the mold 4 is, at least at the time of casting, greater than the area of the section of the vertical casting chamber 28, or at least approximately equal to it. This makes it possible to slow the molten metal as it flows into the ingates, and thus to obtain a non-turbulent filling of the impressions or cavities 29.

6 Claims, 2 Drawing Sheets

METHOD AND APPARATUS FOR LOW-PRESSURE METAL CASTING

BACKGROUND OF THE INVENTION

This invention concerns low-pressure metal casting in a recessed sand mold comprising a casting chamber opening downwardly, at least one impression, and ingates connecting the casting chamber to the or impression(s). The base of the casting chamber is connected to the upper end of a feed tube supplying molten metal, and the metal is made to rise in the tube until it fills the impression(s) via the ingates.

A low-pressure casting method (see, for example, commonly assigned French Patent Nos. 2,295,808; 2,367,566; and 2,556,996) is particularly advantageous, when compared with gravitational casting, for the production of thin-walled metal parts and/or parts having complex shapes and/or parts of large size. In fact, the pressure exerted by the metal, which results from the injection of a gas inside a water-tight cavity containing the molten metal, may be closely and accurately controlled to push the metal into all of the innermost recesses of the impressions.

However, using some casting mold configurations, certain casting defects linked to the filling operation, e.g., small pressurized gas pockets (i.e., incorporation of air bubbles) are seen to appear.

SUMMARY OF THE INVENTION

An object of the invention is to perfect a low-pressure casting method and apparatus to reduce the incidence of the appearance of these defects. According to the method, at at least one point in the casting operation, the metal flow is slowed as it passes through the ingates, and the delivery rate of the metal fed through the feed tube is adjusted to cause the metal to rise above all of the ingates.

The mold comprises a casting chamber opening downwardly, at least one impression, and ingates connecting the casting chamber to the impression(s), and the sum of the areas of the sections of the ingates is, at least at the moment of casting, greater than the area of the section of the casting chamber, or at least approximately equal to it.

In the case of a mold comprising several impressions, in particular, the sum of the areas of the sections of all of the ingates may be greater than the area of the section of the casting chamber, or at least approximately equal to it. More specifically, if the impressions are distributed over n stages, the area of the section of the casting chamber may range between the sum of the areas of the sections of the ingates belonging to $(n-1)$ stages and the sum of the sections of all of the ingates.

If the mold comprises groups of ingates, each fed by an intermediate duct, the area of the section of each duct is at least equal to the sum of the areas of the sections of the ingates which it feeds.

DETAILED DESCRIPTION OF THE PREFERRED EMBODIMENTS

Figure 1:
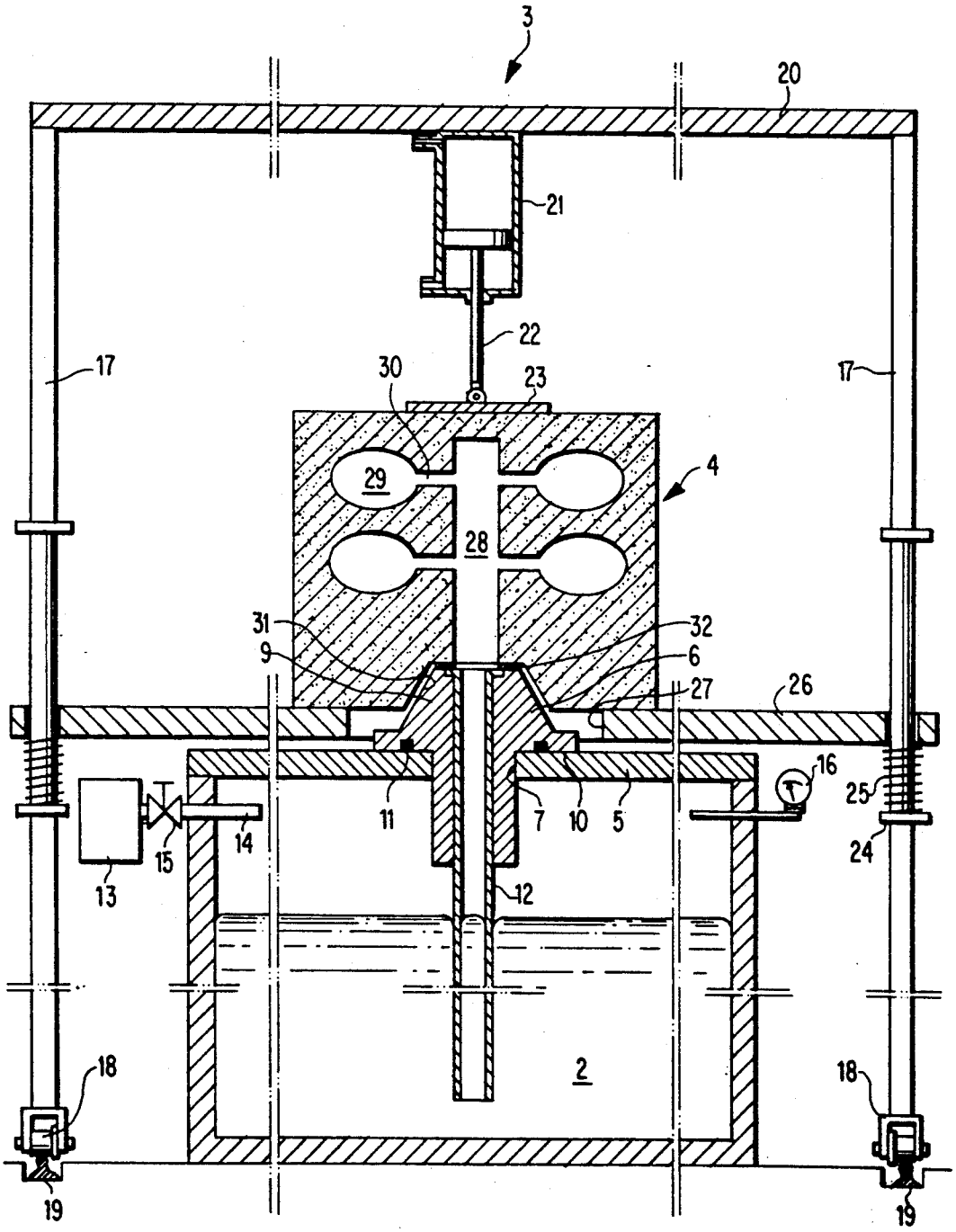
FIG. 1 is a vertical cross-section of a diagrammatic representation of a casting installation according to the invention.

The installation shown in Figure comprises a chamber 1 forming a cavity or reservoir for liquid metal 2, a mold-support frame 3, and a sand mold 4. This installation is used for the low-pressure casting of cast iron (gray cast iron or spherulitic graphite iron), steel, or a superalloy in the mold 4. Except for the internal configuration of the mold, the installation is identical to the one described in French Patent No. 2,295,808, cited above.

The stationary cavity 1 comprises an upper cover 5 attached in water-tight fashion to its lateral walls and locked in place using suitable means (not illustrated). A casting nozzle 6 passes through an orifice 7 in the cover 5. This nozzle 6 comprises a lower tubular part 8 whose external diameter matches the diameter of the orifice 7, and an upper part 9 having a generally tapered shape, whose large flat base 10 rests impermeably on the periphery of the orifice 7. A gasket 11 formed from an asbestos cord is housed in a recess in the base 10 of the nozzle. A feed tube or pipe 12 made of a heat-resistant material and immersed in the cast iron until it reaches the vicinity of the bottom of the cavity 1 passes through the nozzle; the upper part of the pipe 12 opens into the center of the nozzle 6, at the level of its flat upper surface.

The cavity 1 is connected to a pressurized gas source 13 by a pipe 14; the cavity is selectively connected to the pressure source or to the atmosphere by a suitable valve device 15 external to the cavity. A pressure gauge 16 makes it possible to monitor the pressure inside the cavity during casting.

The frame 3 comprises posts 17 fitted at their base with wheels 18 riding on two rails 19. The posts 17 are connected at their upper ends by a ceiling 20 supporting a jack 21 directed downwardly and whose piston rod 22 supports a support plate 23 joined to its lower end.

Each of the posts 17 is also fitted with a collar 24 on which a helical spring 25 rests. A horizontal base plate 26 may slide vertically along a portion of the posts 17 located above the collars 24. This plate 26 rests constantly for support on the upper ends of the springs 25 and is biased upwardly by them. When there is no downward pressure applied to the plate 26, it is positioned at a level above that of the upper surface of the nozzle 6. A circular opening 27 having a diameter large enough to allow the nozzle 6 to pass through it is cut in the plate 26.

The mold 4 is a solid recessed mold produced in at least two parts. It comprises a casting chamber 28 and four impressions 29, each of which is connected to the chamber 28 by an ingate 30, distributed over two stages. The chamber 28 is vertical and has a circular section which is approximately equal to that of the feed tube 12. This chamber is open at the base, which has a flared truncated recess 31 matching the shape of the nozzle 6. It extends up to a certain distance from the upper end surface of the mold. Each pair of the four ingates 30 is parallel and approximately horizontal. They have a rectangular section, which is determined as explained below.

The installation functions in the following way. Since the frame 3 is located at a distance from the cavity 1, a suitable heat-resistant water-tight joint 32 is installed on the bottom of the recess 31 of the mold 4. The mold 4, which contains a core (not shown) in each impression, is positioned on the plate 26 and centered over the opening 27. Next, the frame is moved on the rails 19 to a position above the cavity 1 containing the liquid cast iron, so that the nozzle 6 is positioned opposite the recess 31 of the mold. The jack 21 is then extended to lower, by means of the plate 23, the mold 4 and its support plate 26 against the force of the springs 25. This operation tightens the joint 32 between the bottom of the recess 31 and the nozzle, and ensures a water-tight connection of the casting chamber to the feed tube.

The cavity 1 is then connected to the pressure source 13 by the valve device 15. The pressure acting on the free surface of the cast iron causes it to rise in the tube 12. The cast iron fills the chamber 28 of the mold, the ingates 30, and the impressions 29. The pressure is maintained for a predetermined period of time as a function of the dimensions and shapes of the parts to be produced. During this period, the chamber 28 acts as a reservoir or feeder, by supplying to the impressions the additional liquid cast iron needed to compensate for shrinkage. Next, the ingates 30 solidify, the gas pressure is reduced to atmospheric pressure in the cavity 1 by the valve device 15, and t he liquid cast iron in the chamber 28 and the tube 12 falls back into the cavity, draining these two passages.

The jack pressure is then released, the mold/support plate 26 assembly is pushed away from the nozzle 6 by the springs 25, and the entire frame 3 is moved horizontally away from the cavity on the rails 19.

The preceding description conforms to the technique described in the aforementioned French Patent No. 2,295,808, and the gasket or joint 32 may be as described therein.

In accordance with the present invention, the area of the section of the chamber 28 ranges between the sum of the areas of the sections of the ingates 30 belonging to one stage and the sum of the areas of the sections of all of the ingates. Consequently, when a suitable gas delivery rate is fed through the duct 14, the molten metal rises in the chamber 28, in order to ensure a sufficient metallostatic height at each stage, and the metal pressure decreases as it enters the ingates. This makes it possible to implement multi-stage casting while ensuring a uniform and even metal flow with minimum turbulence and, consequently, reduces the erosion of the sand caused by the flow of the molten metal in the ingates as well as in the impressions themselves. The risks of occlusion caused by air bubbles in the metal and of the appearance of returns are minimized. The ultimate result is greater integrity of the castings.

Figure 2:
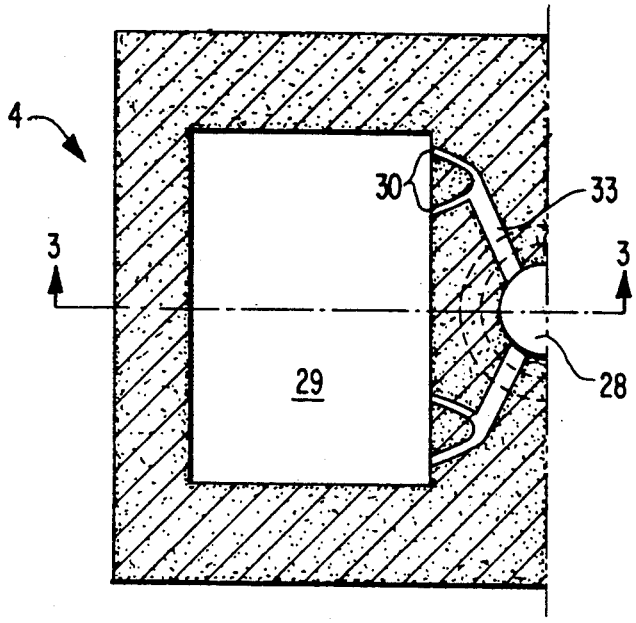
FIG. 2 illustrates diagrammatically another mold that can be used in the installation, shown in cross-section along line II—II in FIG. 3.
Figure 3:
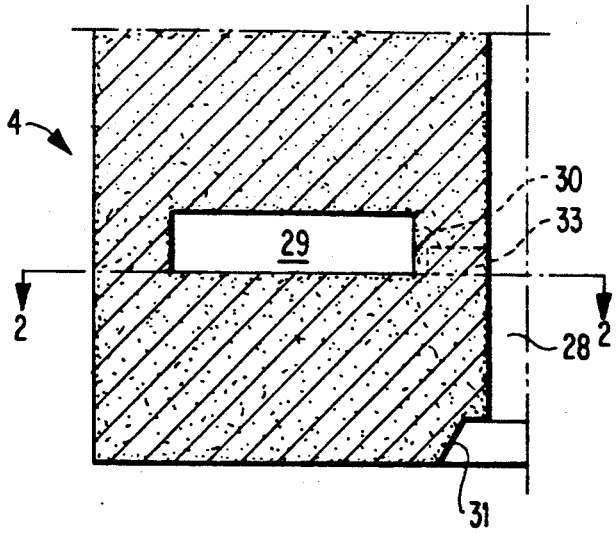
FIG. 3 is a cross-section view of the mold along line III—III in FIG. 2.

The mold partially illustrated in FIGS. 2 and 3 also comprises two impressions 29 per stage. However, in this case, each impression is fed by several ingates 30, and intermediate ducts 33 connect the chamber 28 to two of these ingates, respectively. To achieve the non-turbulent filling method described above, the area of the section of each duct 33 is greater than the sum of the area of the sections of the ingates fed by the duct.

In the case of large-size impressions, a situation corresponding to the feed of each impression through several ingates as shown in FIGS. 2 and 3, it may happen that the ingates belonging to the first stage or stages solidify before the metal reaches the top of the casting chamber. In this case, the cavities (casting chamber, ducts, ingates) of the mold are sized such that the sum of the areas of the sections of the operational ingates (i.e., neither empty nor solidified) is constantly greater than the area of the section of the casting chamber.

I claim:

1. A method of low-pressure metal casting in a recessed sand mold defining a vertical casting member opening downwardly, at least one impression, and ingrates connecting the chamber to the impression, wherein a base of the casting chamber is connected to an upper end of a molten metal feed tube, comprising the steps of, causing molten metal to rise in said tube and in the chamber until it fills the impression via the ingate, and, at at least one point during casting, slowing the molten metal feed rate during the flow thereof through operational ingates;

wherein said slowing of the molten metal feed rate is caused by the sum of the areas of the sections of the operational ingates being, at said least at one point during casting, at least approximately equal to or greater than the area of the section of the casting chamber.

2. A method according to claim 1, wherein the molten metal delivery rate through the feed tube is adjusted to cause the metal to rise in the casting chamber above all of the operational ingates.

3. A recessed sand mold for low-pressure metal casting, comprising, a vertical casting chamber opening downwardly, at least one impression, and ingates connecting the casting chamber to the impression, wherein the sum of the areas of the sections of operational ingates is, at least at one point during casting, at least approximately equal to or greater than the area of the section of the casting chamber.

4. A mold according to claim 3, comprising a plurality of impressions, wherein the sum of the areas of the sections of all of the ingates is at least approximately equal to or greater than the area of the section of the casting chamber.

5. A mold according to claim 4 wherein the impressions are distributed over n stages, and the area of the section of the casting chamber ranges between the sum of the areas of the sections of the ingates belonging to $(n-1)$ stages and the sum of the sections of all of the ingates.

6. A mold according to claim 3, comprising groups of ingates, each of said groups being fed through an intermediate duct (33), and wherein the area of the section of each duct is at least equal to the sum of the areas of the sections of the ingates fed thereby.

* * * * *